US007552995B2

(12) United States Patent
Nakazawa et al.

(10) Patent No.: US 7,552,995 B2
(45) Date of Patent: Jun. 30, 2009

(54) DUPLEX PRINTING SYSTEM

(75) Inventors: Souichi Nakazawa, Ibaraki (JP); Takahiro Inoue, Ibaraki (JP); Atsushi Miyamoto, Ibaraki (JP); Masahiro Mizuno, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 209 days.

(21) Appl. No.: 11/038,095

(22) Filed: Jan. 21, 2005

(65) Prior Publication Data

US 2005/0174379 A1 Aug. 11, 2005

(30) Foreign Application Priority Data

Jan. 23, 2004 (JP) ..... P2004-015433

(51) Int. Cl.
*B41J 2/15* (2006.01)
*B41J 29/393* (2006.01)
*G03G 15/00* (2006.01)

(52) U.S. Cl. ..... 347/40; 347/19; 399/384; 399/19

(58) Field of Classification Search ..... 347/40, 347/19; 399/384, 19
See application file for complete search history.

(56) References Cited

U.S. PATENT DOCUMENTS 3,752,288 A * 8/1973 Detig et al. ..... 400/322
5,725,211 A * 3/1998 Blanchard et al. ..... 271/265.02
5,729,817 A * 3/1998 Raymond et al. ..... 399/384
6,118,950 A * 9/2000 Wibbels et al. ..... 399/16
6,381,440 B1 * 4/2002 Bock et al. ..... 399/384
6,567,621 B2 * 5/2003 Miyoshi et al. ..... 399/19
6,619,202 B2 * 9/2003 Aida ..... 101/232
6,650,864 B2 * 11/2003 Kikuchi et al. ..... 399/384
6,795,683 B2 9/2004 Nakazawa et al.
6,813,451 B2 * 11/2004 Wibbels ..... 399/45
6,988,725 B2 * 1/2006 Rapkin ..... 271/227
7,242,494 B2 * 7/2007 Hanazato ..... 358/1.15
2002/0081132 A1 * 6/2002 Miyamoto et al. ..... 399/384
2002/0181021 A1 * 12/2002 Stephens ..... 358/1.18
2003/0026619 A1 * 2/2003 Miyoshi et al. ..... 399/19
2003/0123081 A1 * 7/2003 Iwasaki ..... 358/1.15

FOREIGN PATENT DOCUMENTS

JP 7-237336 9/1995
JP 2002-187660 7/2002
JP 2003-266825 9/2003

* cited by examiner

*Primary Examiner*—Stephen D Meier
*Assistant Examiner*—Sarah Al-Hashimi
(74) *Attorney, Agent, or Firm*—McGinn IP Law Group, PLLC

(57) ABSTRACT

An operator sets a distance from the page head of an alignment mark using a mark position setting switch mounted in a duplex printing system. A first printer forms the alignment mark in a position of the distance from the page head of a web, and reports position information about the alignment mark to a second printer. The alignment mark is detected by mark detection means of the second printer. Control means performs control of a web transport speed so that a phase between generation timing of a mark detection signal which the mark detection means generates by detecting the alignment mark and control timing calculated from alignment mark position data, alignment mark interval data and a web feed control signal generated at a preset period becomes constant.

17 Claims, 4 Drawing Sheets

DUPLEX PRINTING SYSTEM

BACKGROUND OF THE INVENTION

1. Field of the Invention

The present invention relates to a duplex printing system and a duplex printing method for forming an image etc. on double sides of a web, and particularly to a duplex printing system having an alignment control device for accurately aligning images of double sides.

2. Description of the Related Art

As a printing system for forming an image on double sides of a web typified by long continuous band-shaped paper, a printing system constructed so that two printers are arranged in series and printing is done on the first side (front) of the web by the printer of a forward stage and the front and back of the web delivered from the printer of the forward stage are reversed by a reversing device and then the web is fed into the printer of a backward stage and printing is done on the second side (back) of the web by the printer of the backward stage has been proposed and commercialized.

Recently, as the web used in such a printing system, a printing system capable of coping with a web without feed holes in addition to continuous paper of a form having feed holes in both edges has become widespread. In the printing system as described above, in the case of a printer of a type in which at least a printer arranged in a forward stage forms an image using an electrophotographic method, due to thermal action in a thermal fixing process in which an image (toner image) transferred on a web is melted and fixed in the web, the web fed into a printer of a backward stage thermally shrinks more than the original state and a page length at the time of printing of the front is different from a page length at the time of printing of the back, so that a phenomenon in which an image position of the front side formed on the web does not match with an image position of the back side occurs. In order to cope with such a phenomenon, a printing system using a control method in which an alignment mark is formed in a defined position of the web, for example, the head of a print page in the first printer and timing or an interval of the alignment marks is measured by the second printer and the image position of the front side is matched with the image position of the back side by changing a transport speed of the web from this measured result has been implemented. (Please see JP-A-7-237336 and JP-A-2002-187660.)

SUMMARY OF THE INVENTION

In the printing system as described above, there are cases where a web in which some marks are previously printed in a position of forming the alignment mark is used or a mark etc. used in control of a device for cutting a print result must be printed in the position of forming the alignment mark. At this time, when there is another mark as described above in a formation portion of the alignment mark, it is likely that due to wrong detection of the alignment mark, the image position of the front side largely deviates from the image position of the back side or trouble occurs in control of the cutting device.

It is an object of the invention to provide a duplex printing system capable of implementing control of aligning print positions on both sides even when an alignment mark cannot be formed in a fixed position.

According to one aspect of the invention, there is provided with a duplex printing system including: a first printer for forming an image on a first side of a web without a feed hole; a second printer which is provided in a backward stage of the first printer and forms an image on a second side of the web; a control device for transporting print data and a web transport signal indicating instruction of printing to the first printer and the second printer; mark detection means for detecting an alignment mark formed on the web; and image alignment control means for matching a position of the image formed on the second side with a position of the image formed on the first side of the web by controlling a transport speed of the web so as to match a phase of the web transport signal with a phase of a mark detection signal from the mark detection means By thus configuration, a printing system can accurately print an image on a second side in a state being matched with an image of a first side with stable precision even in the case of using a web in which some marks are previously printed or in the case of having to print a mark etc. used in control of a device for cutting a print result.

DESCRIPTION OF THE PREFERRED EMBODIMENTS

When a control device is equipped with an input device and a display device, implementation is performed by only a change in a control program without adding a component newly.

First Embodiment

In the case of using a web in which some marks are previously printed or in the case of having to print a mark etc. used in control of a device for cutting a print result, a method for avoiding the mark and forming an alignment mark and matching an image of a first side with an image of a second side will be described.

Figure 3:
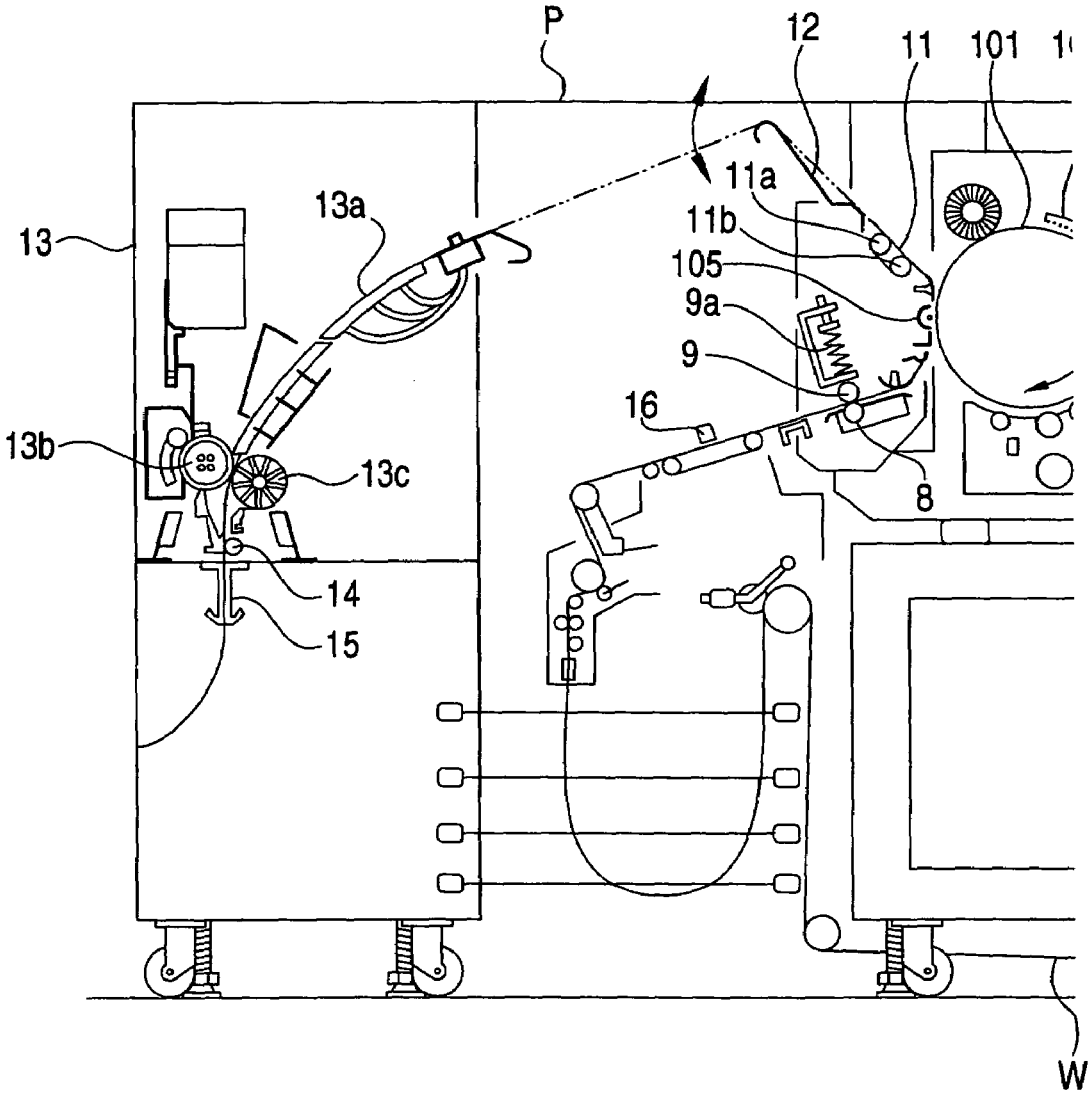
FIG. 3 is a diagram of the whole configuration of a single printer.

First, the whole configuration of an electrophotographic type printer applicable to a duplex printing system will be described using FIG. 3. In FIG. 3, W is a web. The web W is fed into an imaging part 10 by transporting rollers 8, 9. In the imaging part 10, an imaging device by, for example, an electrophotographic recording method is used and when a photosensitive drum 101 exemplified as an image carrier starts rotation, a high voltage is applied to a corona charger 102 and a surface of the photosensitive drum 111 is uniformly charged. In light outputted from a light source 103 made of a semiconductor laser or a light emitting diode, etc., image exposure is performed on the photosensitive drum 101 and an electrostatic latent image is formed on the photosensitive drum 101. When a photosensitive drum region in which this electrostatic latent image is held reaches a position opposed to a developing device 104, a developer is supplied to the electrostatic latent image and a toner image is formed on the photosensitive drum 101. The toner image formed on the photosensitive drum 101 is attracted on the web W by action of a transcribing device 105 for giving an electric charge with polarity opposite to that of the toner image to the rear side of the web W.

The web W to which the toner image is transferred from the imaging part 10 as described above is transported to a backward stage by a transporting belt 11. Here, the transporting roller 8 is provided as a driving roller having a driving source and the transporting roller 9 is provided as a driven roller pressed and contacted to the transporting roller 8 through the web W by elastic force of a spring 9*a*. The transporting belt 11 is looped over the driving roller 11*a* and the driven roller 11*b* and is supported and is configured to have a suction device (not shown) and it is configured so as to be transported with the rear side of the web W sucked on the transporting belt 11.

The web W delivered from the transporting belt 11 is transported to a fixing device 13 through a buffer plate 12. After the web W reaching the fixing device 13 is preheated by a preheater 13*a*, the web W is nipped and transported while being heated and pressurized by a nip part formed by a pair of fixing rollers made of a heating roller 13*b* and a pressurizing roller 13*c*, and the toner image is melted and fixed into the web W.

The web W delivered by the heating roller 13*b* and the pressurizing roller 13*c* passes a delivery roller 14 and is normally divided alternately by pendulum actions of a swing fin 15 and is folded and stacked inside a printer P. On the other hand, when another printer is arranged in a backward stage of the printer P in order to configure a printing system, the web W delivered by the heating roller 13*b* and the pressurizing roller 13*c* passes the delivery roller 14 and is delivered to the outside of the printer P as shown by a broken line in FIG. 3 and is transported toward the second printer (not shown).

A numeral sign 16 shows mark detection means (a mark sensor) for detecting an alignment mark formed on the web W. The mark sensor 16 detects the alignment mark printed on the front of the web W along with an image by the printer of a forward stage, and generates a signal for performing control so as to accurately position an image printed on the back of the web W by the second printer and the image printed on the front of the web W by the first printer (details will be described below).

Figure 2:
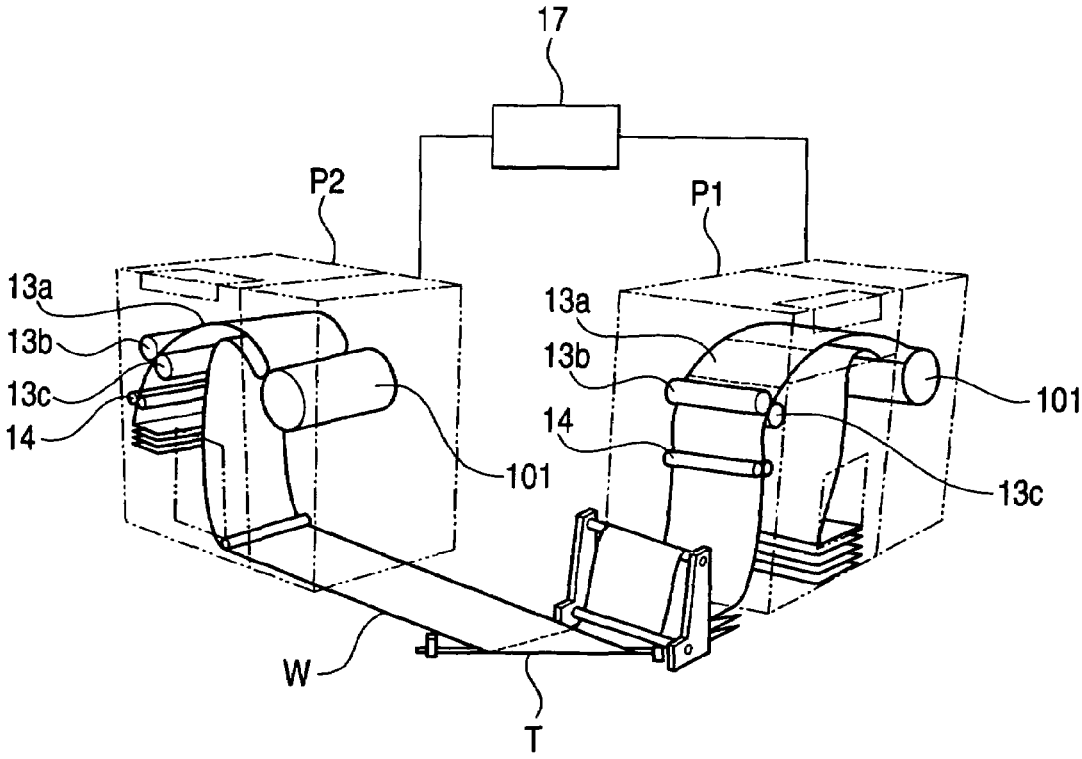
FIG. 2 is a diagram of the whole configuration of a printing system.

The above configuration describes a configuration of a single printer and in the case of being used as a printing system, for example, another printer P is prepared and is installed as shown in FIG. 2. By being installed thus, the front and the back of the web W delivered from the leading printer P1 are reversed by a reversing device T and thereafter, the web is fed into the subsequent printer P2 and an image is formed on the second side of the web W.

Next, a relation between web transport control and an output signal of the mark sensor will be described.

Figure 1:
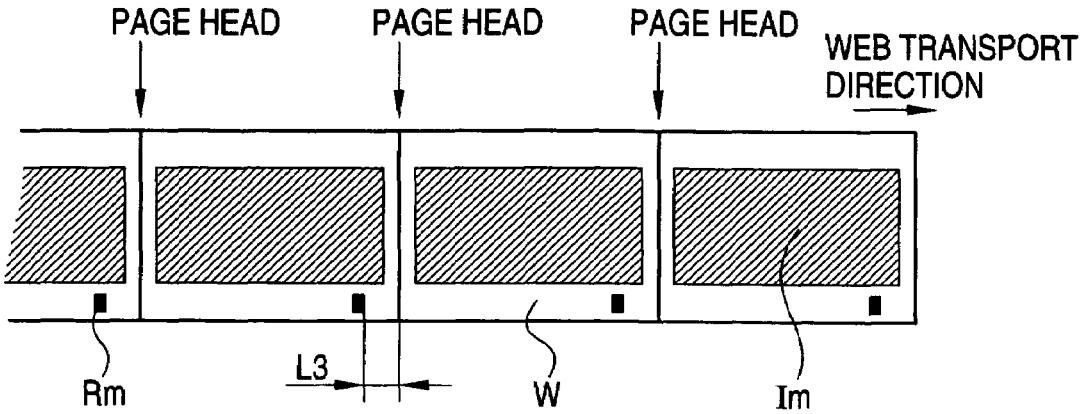
FIG. 1 is a schematic diagram showing a position relation between alignment marks.
Figure 7:
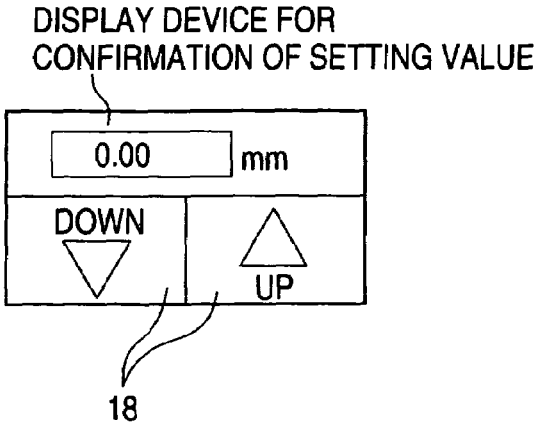
FIG. 7 is one example of a position setting switch of an alignment mark.

In the first printer P1, on a web W, images Im based on print data are printed and alignment marks Rm are printed in specified positions of each page as shown in FIG. 1 and the web is delivered from the printer P1. Incidentally, means for forming the alignment marks may be separately provided independently of means for forming the images Im, or may be formed on the photosensitive drum together with the images Im. In the present example, the alignment marks are formed by the latter configuration. Here, specification of a position of the alignment mark Rm is set by inputting a distance L3 from the page head through a setting switch 18 as shown in FIG. 7 by an operator. The setting switch may be mounted in the printer or may be provided in a controller 17 to transport information to the printer. The setting switch may be attached to a display device for confirmation of a setting value. For example, a setting value increases by 0.01 mm every time an UP switch of the setting switch 18 is depressed and vice versa, the setting value decreases by 0.01 mm every time a DOWN switch of the setting switch 18 is depressed. This setting value refers to a distance from a page head position. In the setting value inputted herein, a position in which a mark other than the alignment marks Rm has not been printed or a position in which the mark is not printed is set. The setting value inputted is recognized by the controller 17 and the alignment mark Rm is printed in the set position. The controller 17 previously reports position information indicating a position of the alignment mark Rm to the printer P2, and the printer P2 grasps the position of the alignment mark Rm with respect to the page head.

The web W delivered from the printer P1 is fed into the second printer P2 after the front and the back are reversed by the reversing device T. By reversal of the front and the back of the web W by the reversing device T, a web side (first side) of the side in which the alignment marks Rm are held is opposed to a detection side of the mark sensor 16 and a web side (second side) in a state of blank paper is opposed to a surface of the photosensitive drum 101.

When an electrostatic latent image corresponding to the page head is formed on the photosensitive drum 101 by the light source 103 of the first printer P1, a web transport control signal (represented by CPF-N in the drawing hereinafter) is formed by the controller 17. Similarly, in the light source 103 of the second printer P2, exposure is started at timing independent of P1 and at this exposure timing, a web transport signal (CPF-N) is generated. The generation timing of the web transport control signal of P1 is independent of that of the web transport control signal of P2 but its interval is equal. The web transport control signals (CPF-N) generated by the controller 17 are respectively sent to the first printer and the second printer and based on the signals, a control signal of a motor for controlling a speed of the web W is generated as described below.

Figure 4:
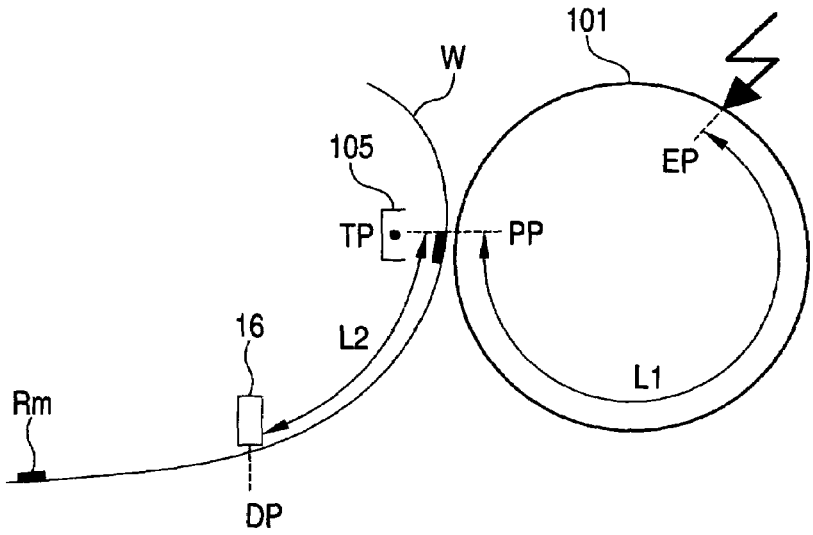
FIG. 4 is an explanatory diagram of alignment control.
Figure 5:
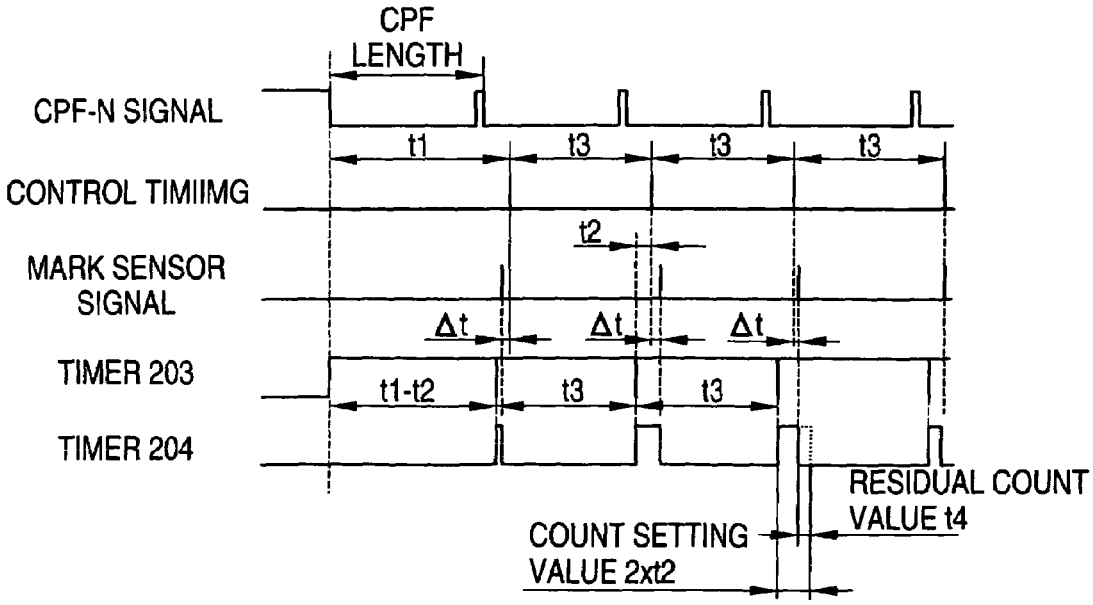
FIG. 5 is a timing chart showing one example of the alignment control.

In FIG. 4 which is an explanatory diagram of alignment control, a position EP on the photosensitive drum 101 is an exposure point and an electrostatic latent image is formed herein. The web transport control signal (CPF-N) shown in FIG. 5 is generated every time the electrostatic latent image corresponding to the page head is formed by the light source 103 such as a laser (FIG. 3). The photosensitive drum 101 is controlled so as to perform constant-speed rotation at a preset process speed, so that the page head on the photosensitive drum 101 reaches a transfer point TP every one period of the web transport control signal, that is, every CPF length. Therefore, the page head on the photosensitive drum 101 can be matched with the page head of the web W at the transfer point TP with high precision by controlling a web transport speed so that a phase difference between timing at which the mark sensor 16 detects the toner mark Rm and originating timing of the web transport control signal (CPF-N) from the controller 17 in the second printer becomes constant.

In the present embodiment, as shown in FIG. 4, a distance on the photosensitive drum surface from the transfer point TP by the transcribing device 105 to the exposure point EP is set at L1 and a distance on a web transport path from the transfer point TP to a detection point DP by the mark sensor 16 is set at L2. Here, in the case of assuming a state of performing web transport in a relation in which PP located downstream by a distance L3 previously known from an electrostatic latent image corresponding to the page head on the photosensitive drum 101 matches with the toner mark Rm of the web W at the transfer point TP, timing at which toner mark Rm is detected by the mark sensor 16 is referred to as control timing in the present specification. In the case of being defined thus, alignment refers to control performed so that the timing at which toner mark Rm is detected by the mark sensor 16, that is, a mark sensor signal of FIG. 5 is always matched with the control timing.

At timing at which print data of the first page starts to be formed on the photosensitive drum 101, the printer receives a CPF-N signal from the controller 17 as shown in FIG. 5. When the CPF-N signal is received, calculation of the control timing is performed. Here, the calculation of the control timing is performed, for example, based on the following idea. That is, when an alignment mark located at the first page on the web W at the time of a web transport start is set at the first mark and an alignment mark first detected after the web transport start is set at the nth mark, in order to match a position PP expected to match with the nth mark hypothetically set on the photosensitive drum 101 with the nth mark Rm on the web W at the transfer point TP, it is necessary to detect the nth mark Rm on the web W at the time when the position expected to match with the nth mark on the photosensitive drum 101 reaches a position of L2 from the transfer point TP. Therefore, when it is assumed that time from the receiving of the first CPF-N signal to the control timing is t1 and a distance from the page head of an alignment mark transferred is L3 and a process speed of the printer is vp and time of intervals between the alignment marks is t3, t1 is expressed by the following formula (1).

$$t1=(L1-L2)/vp+t3.(n-1)+L3/vp. \quad (1)$$

The position PP expected to match with the alignment mark on the photosensitive drum 101 reaches the transfer point TP every interval between the alignment marks, so that the subsequent control timing results in timing every time t3 of intervals between the alignment marks. Incidentally, for ease of understanding herein, as shown in FIG. 1, it is assumed that one alignment mark is present in each page and an interval is the interval of CPF-N.

Figure 6:
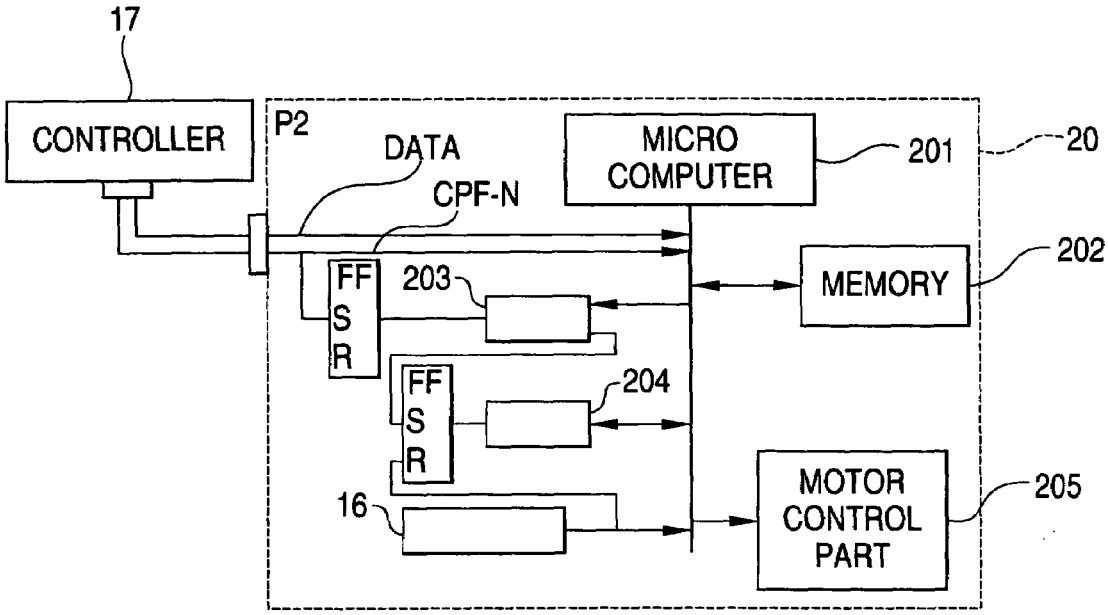
FIG. 6 is one example of a circuit configuration of the alignment control.

Here, a specific embodiment of the formula (1) will be described using FIGS. 5 and 6. FIG. 6 is a control device 20 of the second printer. The control device 20 has communication means with the controller 17, and can receive alignment mark interval information t3 and position information L3 about the alignment mark set by the controller 17. The alignment mark interval information t3 and the position information L3 about the alignment mark reported from the controller 17 are recognized by a microcomputer 201 and are stored in memory 202. L1.L2.*vp* on the formula (1) are fixed values and N is a rounded up value of a quotient of L2/(t3/vp) by a relation between t3 and L2, so that t1 can be calculated by the microcomputer 201. Prior to a printing start, the microcomputer 201 sets a value obtained by subtracting a count value corresponding to fixed time t2 from a count value corresponding to t1 at a timer 203. This t2 is a value obtained by making time conversion of 10 mm, for example, when a detection range of the alignment mark is around 10 mm of the control timing. Similarly, prior to the printing start, the microcomputer 201 sets a count value corresponding to 2×t2 at a timer 204.

The timer 203 is started using a CPF-N signal sent from the controller 17 together with an exposure start as a trigger. When the timer 203 ends counting, a time-out signal is outputted and subsequently, counting is continued by a count value corresponding to t3 after the second. The timer 204 starts counting by this time-out signal. A counting operation of this timer 204 is constructed so as to be stopped by a mark detection signal. When the microcomputer 201 confirms generation of the mark detection signal, residual count data of the stopped timer 204 is read out. A difference .t between detection time of the alignment mark Rm and the control timing can be obtained by t4 in which this residual count data is converted into time. That is, $$.t=t4-t2. \quad \text{formula (2)}$$

From this difference t between detection time of the alignment mark Rm and the control timing, the extent to which a position of the back expected that the alignment mark will matches deviates from an alignment mark position of the front is grasped and a motor control part 205 is operated so that a web transport speed is accelerated when detection timing of the alignment mark Rm is later than the control timing and vice versa, the web transport speed is decelerated when the detection timing of the alignment mark Rm is earlier than the control timing. The web transport speed is controlled so that the detection timing of the alignment mark Rm matches with the control timing.

As described above, the printing system has mark position setting means and based on data set therein, the control timing is shifted in the first printer or the second printer and thereby, alignment of the front and the back with the same precision as that of the conventional art can be performed even when an alignment mark is present in an arbitrary position.

Second Embodiment

A method in which some marks previously printed on a web or a mark etc. used in control of a device for cutting a print result are used and a printer P1 does not form an alignment mark Rm again and an image of a first side is matched with an image of a second side will be described.

First, conditions on which this method can be used are that firstly, the marks can be detected by a mark sensor 16 and secondly, the marks are formed at equal intervals and at equal distances from the page heads.

A mark previously printed on a web or a mark for control of a cutting device is replaced with the alignment mark Rm and a distance L3 from the page head of the alignment mark Rm is set by a setting switch 18. Here, a numerical value measured by a measuring device actually may be used as the distance L3 from the page head of the alignment mark Rm, or the distance L3 can also be set automatically without using the setting switch 18, for example, when a controller 17 grasps the position by a mark printed by the printer P1. The controller 17 previously reports position information indicating a position of the alignment mark Rm to the printers P1 and P2, and the printers P1 and P2 grasp a position of the alignment mark Rm with respect to the page head. The printer P1 aligns the alignment mark Rm with a print page position of the printer P1 using control of matching the page heads of a first side and a second side described in the first embodiment. Further, the printer P2 aligns the alignment mark Rm with the print page position of the printer P1 using the control of matching the page heads of the first side and the second side in a manner similar to the printer P1.

What is claimed is:

1. A duplex printing system, comprising:

a first printer for forming an image on a first side of a web without a feed hole;

a second printer which is provided in a backward stage of the first printer and forms an image on a second side of the web;

a control device for transporting print data and a web transport signal indicating instruction of printing to the first printer and the second printer;

a setting portion to assign a setting value indicating a position of an alignment mark on the web;

mark detection means for detecting the alignment mark formed on the web; and image alignment control means for matching a position of the image formed on the second side with a position of the image formed on the first side of the web by controlling a transport speed of the web so as to match a phase of the web transport signal with a phase of a mark detection signal from the mark detection means, wherein the image alignment control means has position information indicating a position in which the alignment mark is formed and calculation means for calculating timing at which the alignment mark is to be detected by the position information, wherein the image alignment control means aligns the images based on the alignment mark detection timing calculated by the calculation means, and wherein when a previously applied mark comprising a mark, other than the alignment mark, is formed on the web, the setting value is set to indicate a position in which the previously applied mark is not formed.

2. The duplex printing system according to claim 1, wherein the first printer has mark formation means for forming the alignment mark in a previously specified position of each page of the web.

3. The duplex printing system according to claim 2, wherein the control device instructs the first printer to form the alignment mark in a position of the position information with respect to each page of the web.

4. The duplex printing system according to claim 3, wherein the setting portion is capable of arbitrarily setting the position information.

5. The duplex printing system according to claim 1, wherein the control device reports the position information to the first and second printers.

6. The duplex printing system according to claim 5, wherein the control device has mark position setting means capable of arbitrarily setting the position information.

7. The duplex printing system according to claim 1, wherein the mark detection means is disposed in the second printer.

8. The duplex printing system according to claim 1, wherein the image alignment control means is disposed in the second printer.

9. The duplex printing system according to claim 1, wherein the setting portion comprises a setting switch to set a value of the placement of the alignment mark at a desired position.

10. The duplex printing system according to claim 1, wherein a position of the alignment mark is reported to the second printer and stored in a memory.

11. The duplex printing system according to claim 1, wherein a phase difference between timing at which the mark detection means detects the alignment mark and a timing signal from the control device in the second printer is constant.

12. The duplex printing system according to claim 1, wherein a control timing is based on detection of the alignment mark.

13. The duplex printing system according to claim 12, further comprising a motor control part that controls a transport speed of the web based on detection timing of the alignment mark and the control timing.

14. The duplex printing system according to claim 1, wherein the image alignment control means receives alignment mark interval information from the control device and stored in a memory.

15. The duplex printing system according to claim 14, wherein the alignment mark position information and the alignment mark interval information are stored in a memory of the image alignment control means.

16. The duplex printing system according to claim 1, wherein the previously applied mark comprises one of:

a mark indicating a cutting portion of the web; and a mark that is different from the alignment mark and that is printed by the first printer.

17. The duplex printing system according to claim 1, wherein the setting value indicates a distance from a page head position, and wherein the second printer determines a position of the page head position based on the setting value that indicates the position in which the previously applied mark is not formed.

* * * * *